US009803319B2

(12) United States Patent
Hallas

(10) Patent No.: US 9,803,319 B2
(45) Date of Patent: Oct. 31, 2017

(54) PRESS ROLL COMB PLATE AND RELATED METHOD

(71) Applicant: Andritz Inc., Glens Falls, NY (US)

(72) Inventor: Gregory Hallas, Suwanee, GA (US)

(73) Assignee: Andritz Inc., Glens Falls, NY (US)

( * ) Notice: Subject to any disclaimer, the term of this patent is extended or adjusted under 35 U.S.C. 154(b) by 132 days.

(21) Appl. No.: 14/966,809

(22) Filed: Dec. 11, 2015

(65) Prior Publication Data

US 2016/0177507 A1 Jun. 23, 2016

Related U.S. Application Data

(60) Provisional application No. 62/094,586, filed on Dec. 19, 2014.

(51) Int. Cl.

| | |
|---|---|
| ***D21F 3/08*** | (2006.01) |
| ***D21C 9/02*** | (2006.01) |
| ***D21C 9/06*** | (2006.01) |
| ***D21C 9/18*** | (2006.01) |
| ***B30B 9/20*** | (2006.01) |

(52) U.S. Cl.

CPC ..... *D21F 3/083* (2013.01); *B30B 9/205* (2013.01); *D21C 9/02* (2013.01); *D21C 9/06* (2013.01); *D21C 9/18* (2013.01)

(58) Field of Classification Search

CPC ..... B30B 9/205; D21F 3/083; D21F 5/046; D21C 9/02; D21C 9/06; D21C 9/18; D21C 9/007; D21D 5/06; D21D 5/16; F26B 13/008

See application file for complete search history.

(56) References Cited

U.S. PATENT DOCUMENTS

| | | | | |
|---|---|---|---|---|
| 3,014,589 | A * | 12/1961 | Frykhult | D21C 9/06 210/123 |
| 4,217,170 | A * | 8/1980 | Luthi | D21C 9/06 162/380 |
| 4,581,139 | A | 4/1986 | Kosonen | |
| 4,906,364 | A | 3/1990 | Luthi | |
| 5,046,338 | A | 9/1991 | Luthi | |
| 5,296,152 | A * | 3/1994 | Frykhult | B01D 33/23 210/327 |

(Continued)

FOREIGN PATENT DOCUMENTS

| | | |
|---|---|---|
| WO | PCT/SE2010/050237 | 9/2010 |
| WO | PCT/SE2010/050263 | 12/2010 |

(Continued)

OTHER PUBLICATIONS

Ponsaud, Philippe, European Search Report, dated Apr. 8, 2016, pp. 1-5, European Patent Office, Munich, Germany.

*Primary Examiner* — Jason L Vaughan

(74) *Attorney, Agent, or Firm* — Kerri Hochgesang; Robert Joseph Hornug

(57) ABSTRACT

The problem of deck channel rewetting that occurs when a drainage chamber in a roll upwardly approaches a horizontal line extending past the horizontal diameter of the roll is solved by using a comb plate comprising at least one comb tooth engaging the perforated plate and extending through a deck channel to a drainage channel such that the at least one comb tooth has a slope configured to direct a slurry suspension from the perforated plate into the drainage channel.

15 Claims, 9 Drawing Sheets

(56) References Cited

U.S. PATENT DOCUMENTS

| | | | | | |
|---|---|---|---|---|---|
| 5,316,675 | A * | 5/1994 | Frykhult | B01D 33/23 | 210/327 |
| 5,330,646 | A * | 7/1994 | Frykhult | B01D 33/23 | 210/327 |
| 5,470,471 | A | 11/1995 | Luthi | | |
| 5,480,546 | A * | 1/1996 | Bergkvist | D21C 9/06 | 162/58 |
| 5,667,642 | A | 9/1997 | Luthi | | |
| 6,311,849 | B1 | 11/2001 | Sbaschnigg | | |
| 7,285,180 | B2 | 10/2007 | Sicley | | |
| 8,092,653 | B2 | 1/2012 | Lundberg | | |
| 8,562,498 | B2 * | 10/2013 | Mossberg | D21C 9/06 | 492/20 |

FOREIGN PATENT DOCUMENTS

| | | |
|---|---|---|
| WO | PCT/SE2010/050543 | 12/2010 |
| WO | PCT/SE2010/051308 | 6/2011 |
| WO | PCT/SE2012/051089 | 4/2013 |
| WO | 2014182224 A1 | 11/2014 |

* cited by examiner

PRESS ROLL COMB PLATE AND RELATED METHOD

RELATED APPLICATION

This application claims the benefit of U.S. provisional patent application 62/094,586, filed on Dec. 19, 2014, the entirety of which is incorporated herein by reference.

BACKGROUND OF THE INVENTION

1. Technical Field

The present disclosure relates generally to anti-rewet inserts for a rotating thickening device and particularly to anti-rewet inserts for roll presses commonly used in the pulp and paper industry.

2. Related Art

Pulp and paper manufacturers commonly use roll presses to wash, dewater, and thereby thicken papermaking pulp. For example, manufacturers may use a roll press to thicken pulp slurries from 2.5 percent consistency to between 30 and 50 percent consistency. Consistency is generally measured as a percent of dry fiber in a given weight of slurry.

Generally, the rolls within the roll presses have support ribs arrayed lengthwise upon a cylindrical core. The gaps between the support ribs define drainage channels and the support ribs themselves support a cylindrical deck. The deck may be a thick-walled hollow roll shell, or a series of deck rings oriented perpendicular to the support ribs. In either configuration, the hollow roll shell or the deck rings support a perforated plate. The perforated plate generally defines the outer diameter of the roll in the roll press. The gaps between the deck rings define deck channels. In configurations where the deck is a hollow roll shell, the hollow spaces within the hollow roll shell define a deck channel. In either general configuration, the deck channels provide liquid communication between the perforated plate and the drainage channels. That is, filtrate that flows through the perforated plate enters a deck channel before falling into a drainage channel.

A roll press housing typically contains one or two rolls. A roll press containing two rolls is generally known as a "twin roll press." A trough exists between the perforated plate and the inner wall of the housing. The inner wall is usually configured such that the trough is at least partially concentric with the outer diameter of a roll; that is, the trough generally follows the contour of the roll's outer diameter at least partially. This trough may contain one or more baffles that arc gradually toward the perforated plate. The narrowest point between an end of the baffle and the perforated plate is generally known as a "nip." A nip is generally configured to press pulp in the trough toward one or more perforated plates. In a twin roll press, the narrowest space between the perforated plates of adjacent rolls is also a "nip" and may be designated as a "twin nip" for clarity. In a twin roll press, one roll rotates in a clockwise direction and the second roll rotates in a counter-clockwise direction such that the pulp slurry is directed to the twin nip between the first and second roll.

In conventional roll presses, pulp slurry generally enters the roll press assembly though a side inlet. As the roll rotates, the pulp slurry flows through the trough and around the bottom portion of the roll. Meanwhile, the baffles, such as the baffles described in U.S. Pat. No. 8,828,189, gradually press the moving pulp slurry toward the perforated plate as the slurry moves past each nip at the end of the baffle. As the nips press the pulp, excess liquids and dissolved solids, commonly known as "filtrate", seep through the deck perforations. As the liquids filter out of the pulp, the consistency of the pulp slurry increases to the point that baffles can form the pulp slurry into a low-consistency pulp mat around the perforated plate. Additional nips further press the pulp mat toward the perforated plate and thereby expel additional filtrate to increase further the pulp mat's solids consistency. The nips press the pulp mat or pulp suspension and force filtrate through the perforated plate and may flow across the deck channels into the drainage channels.

The filtrate then flows along the length of the drainage channel and exits the roll at either end of the drainage channel. Gravity generally assists filtrate drainage when a drainage channel rotates upwardly past the center line. The center line is an imaginary horizontal line extending from the 3 o'clock position to the 9 o'clock position on each roll.

A doctor blade is generally located above the center line. The doctor blade typically scrapes the pulp mat from the perforated plate as the roll rotates. The liberated pulp mat then exits the roll press housing for further processing. As the roll continues to rotate, the freshly exposed section of perforated plate contacts newly added pulp slurry to repeat the cycle. A side inlet usually conveys the newly added pulp slurry into the roll press housing.

The rate at which filtrate exits the drainage channels is a function of time. If a roll press rotates sufficiently slowly, most filtrate extracted from the pulp mat may exit the drainage channels when the drainage channels are above the centerline. However, at practical production rates, this is rarely accomplished.

As capacity demands increase, longer rolls, higher roll speeds, and an increase filtrate flow may be required. Additionally, demands for higher consistency pulp may increase the nip load. If designers thicken the deck, support ribs, or core to support increased nip loads, the drainage channel area may decrease, especially if designers maintain a roll diameter configured to work in existing roll press housings. Increased production may encourage a greater volume of filtrate to flow through these smaller drainage channels.

As a result, at practical production rates, not all filtrate exits the drainage channels when the drainage channels are above the center line. When this happens, the remaining filtrate can flow back into new, diluted pulp slurry when the roll rotates downwardly past the center line. In the case of a wash press, such rewetting with dirty filtrate reduces washing efficiency. The new dilute pulp slurry or pulp mat absorbs this filtrate. Returning filtrate into the pulp mat reduces the pulp mat's consistency and requires a greater nip load to expel the filtrate to achieve the desired consistency. Additionally, the increased nip load can damage the pulp mat and stress the roll, which can lead to an increased maintenance need and corresponding increase in production loss. In roll presses that are used for washing the pulp, filtrate flowing back into the pulp dirties the pulp and encourages operators to use more cleaning chemicals to achieve the desired product.

Operators have previously used rolls with anti-rewet apparatuses and inserts disposed in the drainage channels to attempt to address that rewetting that occurs as the drainage channel rotates downwardly toward the center line. These conventional anti-rewetting apparatuses however, are not configured to address the rewetting that occurs when the roll rotates upwardly toward the center line.

As a drainage channel rotates upwardly toward the center line, nips force filtrate through the perforated plate. A portion of the overall volume of the filtrate may seep through the perforated plate but fall downwardly along the deck channel without entering a drainage channel. This filtrate portion diffuses back through the perforated plate to be reabsorbed by the pulp map or pulp slurry. Rewetting in this manner likewise lowers pulp mat consistency, reduces the cleanliness of the pulp mat, and generally increases the energy required to obtain a desirable product.

SUMMARY OF THE INVENTION

The problem of deck channel rewetting that occurs when a roll drainage channel approaches and passes the center line is mitigated by using a comb plate, the comb plate comprising a comb tooth extending through a deck channel toward a drainage channel, the comb tooth having a first end disposed on a back of a perforated plate and a second end opposite the first end, wherein the first end and the second end of the comb tooth define a slope configured to direct filtrate passing through the perforated plate through the deck channel into the drainage channel; and an anti-rewet plate under the perforated plate wherein the anti-rewet plate has a first end extending into the drainage channel and a second end, wherein the first end and the second end define a slope configured to hold a volume of filtrate as the drainage channel rotates downwardly between the center line and the nadir of the roll.

Roll presses generally require significant investment. Modifications to existing roll presses may cost more than the expected benefit resulting from the increase in efficiency. Accordingly, there is a long felt need to devise a drainage channel insert that decreases rewetting at substantially all drainage channel orientations as the drainage channels rotate in the roll press.

By using a comb plate in accordance with this description, operators are able to extend the comb plate along the length of a drainage channel and tilt the comb teeth into the deck channels defined by deck rings encircling the support ribs. The support ribs may be longitudinal support ribs. The comb teeth contact the back of the perforated plate and may extend through the deck channel to a drainage channel. The comb tooth may have sides that engage the deck rings that define the deck channel. In this manner, the comb teeth of the comb plate may direct filtrate from the perforated plate through the deck channel and into the drainage channel. One or more comb teeth may prevent the filtrate from falling through the deck channel unhindered until the filtrate diffuses back through the perforated plate to rewet the pulp slurry or pulp mat.

The comb plate may be made of stainless steel, duplex high grade steel, or other material configured to withstand the caustic environment of the drainage channel and intermittent forces of between 800 pounds per linear inch (PLI) and 1,500 PLI. The comb plate may be generally sinusoidal, linear, concave relative to an approaching nip, planar, or convex relative to an approaching nip.

It is an object of the present disclosure to provide an apparatus by which the rewetting that occurs when a drainage channel upwardly approaches the horizontal line is reduced.

It is a further object of the present disclosure to provide an apparatus configured to prevent rewetting as the drainage channel rotates and begins to approach the center line downwardly.

It is yet a further object of the present disclosure to provide an anti-rewet insert that reduces rewetting when the drainage channel is at the nadir of the drainage channel's rotation on the roll.

It is an object of the present disclosure to increase the efficiency by which roll presses increase the pulp consistency.

It is an object of the present disclosure to reduce the amount of cleaning liquids required to clean the pulp mat.

It is an object of the present disclosure to reduce the amount of pressure each nip exerts on the pulp mat to achieve a pulp mat of a desirable consistency.

It is an object of the present disclosure to prevent or substantially reduce rewetting of the pulp slurry or pulp mat below the center line as the pulp slurry or mat approaches the center line in an upward direction.

BRIEF DESCRIPTION OF THE DRAWINGS

The foregoing will be apparent from the following more particular description of exemplary embodiments of the disclosure, as illustrated in the accompanying drawings in which like reference characters refer to the same parts throughout the different views. The drawings are not necessarily to scale, with emphasis instead being placed upon illustrating embodiments of the disclosed device.

DETAILED DESCRIPTION OF THE INVENTION

Figure 1:
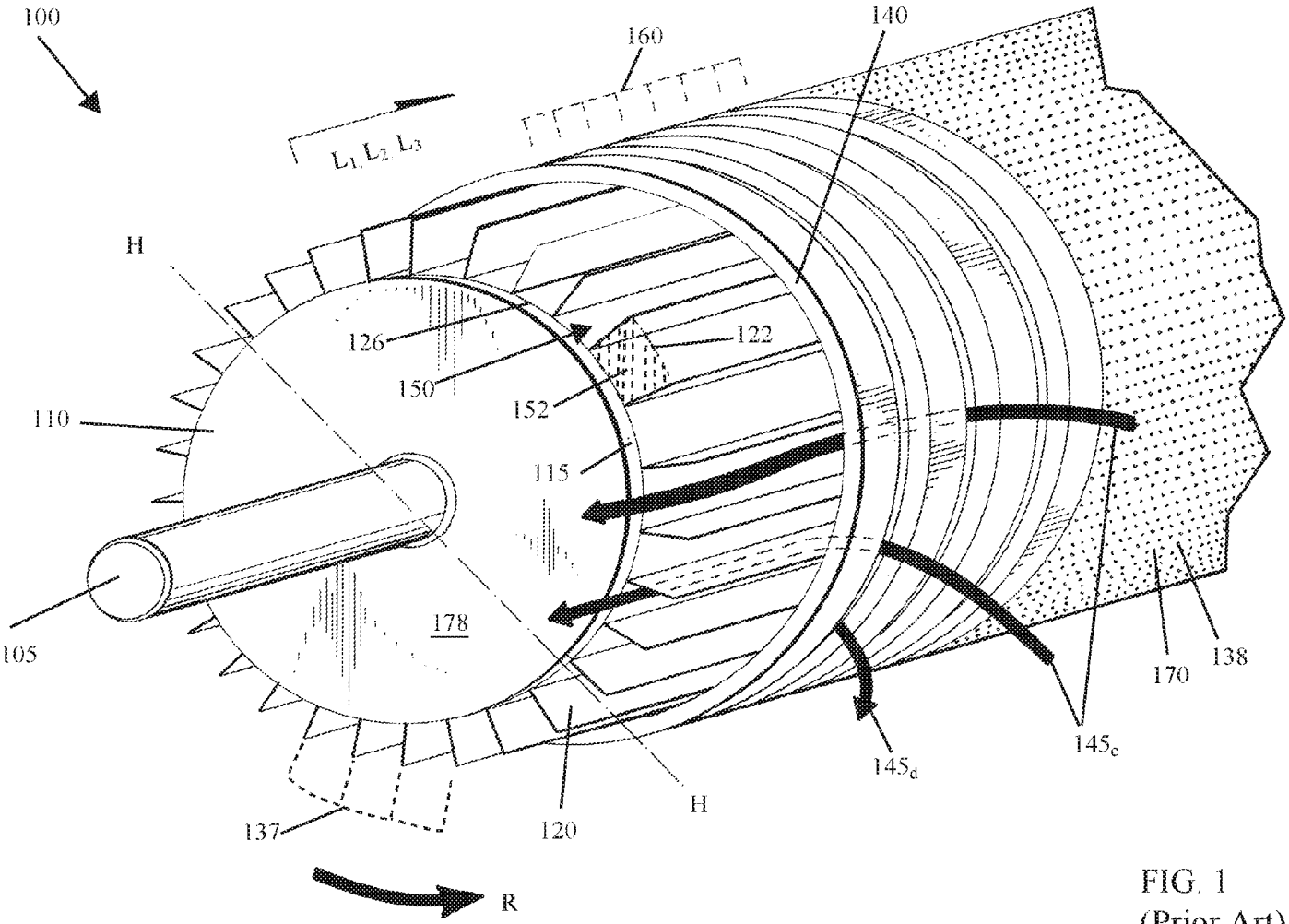
FIG. 1 (Prior Art)
FIG. 1 is a perspective view of a conventional roll used in a roll press.

The following detailed description of the preferred embodiments is presented only for illustrative and descriptive purposes and is not intended to be exhaustive or to limit the scope and spirit of the invention. The embodiments were selected and described to best explain the principles of the invention and its practical application. A person of ordinary skill in the art will recognize that many variations can be made to the invention disclosed in this specification without departing from the scope and spirit of the invention. Except as otherwise stated, corresponding reference characters indicate corresponding parts throughout the several views. Although the drawings represent embodiments of various features and components according to the present disclosure, the drawings are not necessarily to scale and certain features may be exaggerated in order to better illustrate embodiments of the present disclosure, and such exemplifications are not to be construed as limiting the scope of the present disclosure in any manner.

Figure 2:
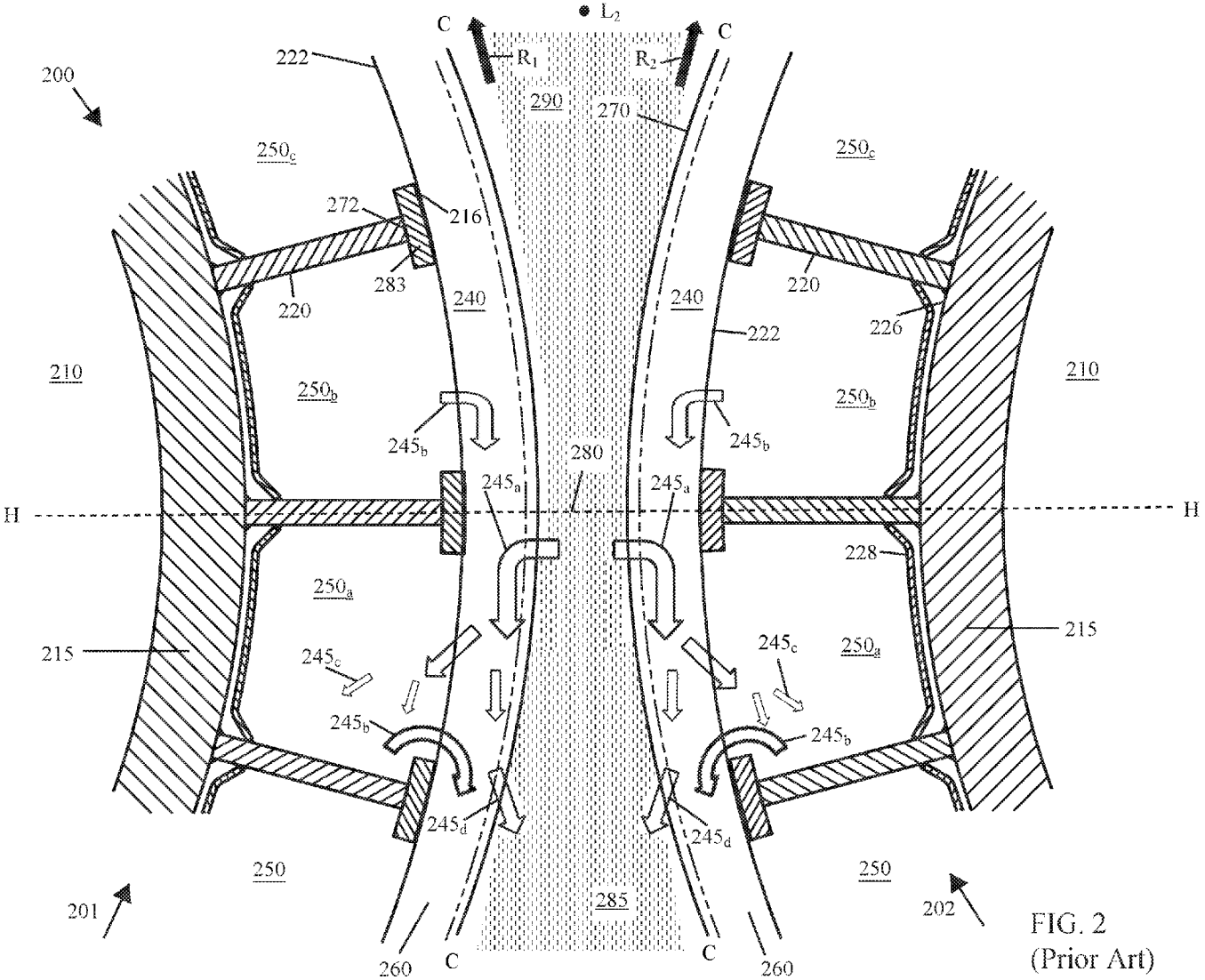
FIG. 2 (Prior Art)
FIG. 2 is a cross-sectional view of a conventional twin roll press depicting a twin nip between the left roll and the right roll.

FIG. 1 is a perspective view of a conventional roll 100. The core 110 is disposed around a journal 105. Division rings 115 provide structural support for the core 110. Support ribs 120 are arrayed around the core 110 at intervals 137. Each support rib 120 has a length $L_1$ that extends lengthwise along the length $L_3$ of the core 110. The area between adjacent support ribs 120 defines a drainage channel 150. The bottom 126 of the drainage channel 150 can be a division ring 115, or part of the core 110. Deck rings 140 encircle the support ribs 120 perpendicularly with respect to the length $L_1$ of the support ribs 120. The length $L_1$ of the support ribs 120 is substantially congruent with the length $L_2$ of the drainage channels 150. The areas between the deck rings 140 define deck channels 160 in liquid communication with the drainage channels 150, that is, filtrate 145 may flow freely between the deck channels 160 and the drainage channels 150. The deck rings 140 likewise support a perforated plate 170. The perforated plate 170 is configured to support a pulp mat 290 (FIG. 2). The "deck" commonly refers to the deck rings 140 together with the deck channels 160 and perforated plate 170. The perforated plate 170 has areas defining perforations 138 that are in liquid communication with the deck channels 160.

The roll 100 depicted in FIG. 1 rotates in a counter clockwise direction R around the journal 105. One or more nips (see 280, FIG. 2) press filtrate 145 from the pulp slurry 285 (FIG. 2) or the pulp mat 290 as the pulp slurry 285 or pulp mat 290 approaches the center line H in an upward direction. A portion of the filtrate $\mathbf{145}_c$ may flow through the perforated plate 170, across each deck channel 160, across the top 122 of the drainage channel 150, and into one or more drainage channels 150. Once in the drainage channels 150, the filtrate $\mathbf{145}_c$ may begin to flow along the length $L_2$ of the drainage channels 150 and flow out the ends 152 of the drainage channels 150. The ends 152 of the drainage channels are disposed at the ends 178 of the roll 100. After the filtrate $\mathbf{145}_c$ exits a drainage channel 150, the filtrate $\mathbf{154}_c$ may be collected and removed from the roll press assembly. As each drainage channel 150 rotates upwardly past the center line H, the rate at which filtrate $\mathbf{145}_c$ flows through the drainage channels 150 generally increases.

However, in conventional designs, a portion of the overall filtrate volume (see $\mathbf{545}_e$, FIGS. 5A and 5B) does not exit the drainage channels 150 when the drainage channels 150 are above the center line H. As a drainage channel 150 begins to approach the centerline H in a downward direction, filtrate 145 can flow back through the top 122 of the drainage channel 150, across the deck channel 160 and back through the perforated plate 170. This can be known as "downward rewetting." The filtrate 145 that flows back through the perforated plate 170 rewets the incoming pulp slurry 285 or pulp mat 290, depending upon where the pulp mat 290 is formed along the surface of the perforated plate 170. Conventional anti-rewet inserts have attempted to address only the rewetting that occurs as the drainage channel 150 rotates downwardly toward the center line H.

Applicant has discovered that "upward rewetting" can also occur as the drainage channel 150 rotates upwardly toward the center line H. When the drainage channel 150 rotates upwardly toward the center line H, a portion of the filtrate $\mathbf{145}_d$ does not remain in either the deck channel 160 or drainage channel 150. Rather, this volume of the filtrate $\mathbf{145}_d$ can flow back through the perforated plate 170 to rewet the pulp mat 290 or pulp slurry 285.

FIG. 2 is a cross-sectional view of a conventional twin roll press 200 illustrating upward rewetting in more detail. FIG. 2 depicts a counter-clockwise roll 201 rotating in a counter-clockwise direction $R_1$ and a clockwise roll 202 rotating in a clockwise direction $R_2$. As the rolls 201, 202 rotate, each roll 201, 202 directs pulp slurry 285 toward the twin nip 280. The twin nip 280 is sometimes known as an "A-nip". The twin nip 280 may be the final nip that presses the pulp slurry 285 into a pulp mat 290 before the pulp mat 290 exits the twin roll press 200. In conventional multi-nip configurations, baffles can create prior nips (such as the ones depicted in U.S. Pat. No. 8,828,189 the entirety of which is incorporated herein by reference). These prior nips can create a pulp mat 290 before the pulp slurry 285 reaches the twin nip 280. Filtrate is represented by the arrows 245. As the pulp slurry 285 approaches the twin nip 280, the rolls 201, 202 press the filtrate 245 from the pulp slurry 285 through the perforated plate 270 and into the deck channels 260. A portion of the excess fluid 245 flows into the drainage channel $\mathbf{250}_a$ and remains in the drainage channel 250 as the drainage channel $\mathbf{250}_b$ rotates upwardly past the center line H. As the drainage channel 250 continues to rotate upwardly, the filtrate 245 may flow along the cladding plate 228 out toward the ends 152 of the drainage channels 250. The cladding plate 228 may extend between adjacent support ribs 220 above the bottom 226 of the drainage channel $\mathbf{250}_a$, $\mathbf{250}_b$, and 250*c*.

Of the total volume of filtrate 245, a portion of the filtrate $\mathbf{245}_a$ may pass the perforated plate 270 without entering the drainage channels 250. This portion of the filtrate $\mathbf{245}_a$ may be deflected by the top 272 of a support rib 220, or top 216 of a deck support structure 283. Additionally, the portion of the filtrate $\mathbf{245}_a$ may not pass the perforated plate 270 with sufficient force, and therefore may not have sufficient energy to enter the drainage channels 250. In either situation, this portion of the filtrate $\mathbf{245}_a$ is deflected downwardly along a circumference C of the deck channel 260 and re-enters the pulp slurry 285 as represented by portion of filtrate $\mathbf{245}_d$.

A portion of the filtrate $\mathbf{245}_b$ that does enter the top 222 of the drainage channel $\mathbf{250}_a$ upwardly approaching the center line H may also exit the top 222 of the drainage channel $\mathbf{250}_a$ and flow downwardly along the circumference C of the deck channel 260. This portion of filtrate $\mathbf{245}_b$ is most likely to exit the drainage channel $\mathbf{250}_a$ if the filtrate 245 enters the drainage channel $\mathbf{250}_a$ with excessive force or if the volume of filtrate $\mathbf{245}_c$ already retained in the drainage channel $\mathbf{250}_a$ is sufficiently high.

Regardless of the manner in which the filtrate 245 begins to travel downwardly along the circumference C of the deck channel 260, the filtrate $\mathbf{245}_d$ flows back through the perforated plate 270 and re-enters the pulp slurry 285 or pulp mat 290 (depending on the operating parameters of the twin roll press 200). The filtrate 245 that flows back through the perforated plate 270 dirties and dilutes the pulp slurry 285 or pulp mat 290, thereby encouraging operators to use more energy and cleaning chemicals to produce a dried pulp of a desired consistency and brightness. In twin roll presses 200 and rolls 100 generally, the amount of filtrate 245$_b$ lost in the deck channels 260 decreases as the drainage channel 250$_c$ continues to rotate upwardly past the center line H. Likewise, the amount of filtrate 245 that flows through the ends 152 of the drainage channels 250 increases as the drainage channels 250$_c$ rotate upwardly past the center line. Eventually, the drainage channel rotates past the apex of the roll (A in FIG. 5) and begins a downward descent. Filtrate 245$_c$ that does not drain completely from the drainage channels 250$_c$ when the drainage channels 250$_c$ rotate within about 30 degrees and about 150 degrees from the center line H begins to exit the top 222 of the drainage channels 250 as the drainage channels 250 approach the center line H downwardly. In conventional roll designs, "rewetting" refers only to filtrate 245 re-entering the pulp slurry 285 or pulp mat 290 as the drainage channels 250 begin to rotate downwardly toward the center line H.

Figure 3:
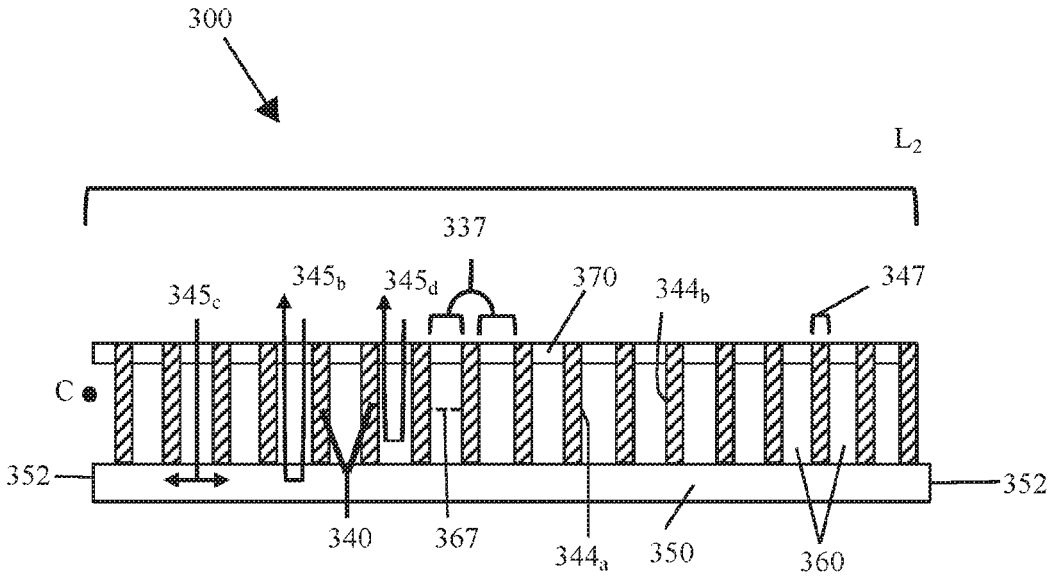
FIG. 3 (Prior Art)
FIG. 3 is a cross-sectional view of a conventional roll bisected along the length of the roll to depict the deck channels surrounding the roll's periphery.

FIG. 3 is a detailed cross-sectional view of a roll 300 cut along the length $L_2$ of a drainage channel 350. The deck rings 340 each have a width 347. The deck rings 340 are disposed along the support ribs 220 at intervals 337. The sides 344$_a$, 344$_b$ of the deck rings 340 define deck channels 360, each having a deck channel width 367. The perforated plate 370 is disposed upon the deck rings 340. Filtrate 345$_c$ that flows through the perforated plate 370, across the deck channels 360 and into the drainage channel 350 may flow out of the roll 300 through the ends 352 of the drainage channel 350. A portion of the filtrate 345$_b$ may enter the drainage channel 350 and exit the drainage channel 350 before the drainage channel passes centerline H. This portion of filtrate 345$_b$ can flow back through the perforated plate 370 and thereby contribute to upward rewetting. A portion of the filtrate 345$_d$ may fall through the circumference C of the deck channel 360 without ever entering the drainage channel 350. This portion of filtrate 345$_d$ can flow back through the perforated plate 370, which can further contribute to upward rewetting.

Figure 4:
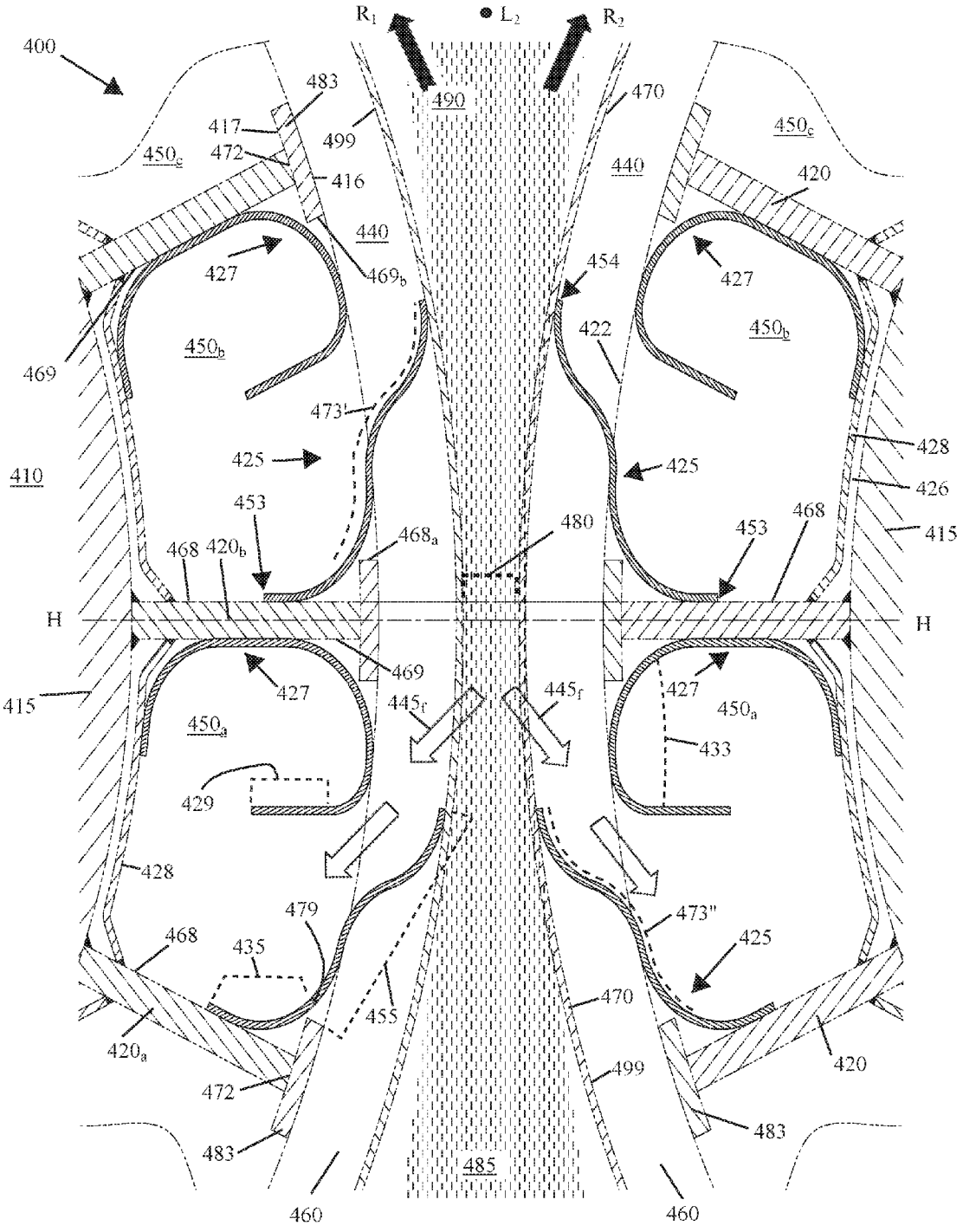
FIG. 4 is a cross-sectional view of an exemplary embodiment of the present disclosure depicting a twin roll press with an anti-rewet insert comprising a comb plate extending to the back of the perforated plate and an anti-rewet plate disposed within a drainage channel.

FIG. 4 is a cross-sectional view of a twin press roll 400 looking down the length $L_2$ of the drainage channel 450. Each drainage channel 450 has an exemplary comb plate assembly 425 comprising a comb tooth 455 extending from the top 422 of the drainage channel 450 and terminating on the bottom 499 of the perforated plate 470. The end of the comb tooth 455 disposed proximate to the bottom 499 of the perforated plate 470 may be the first end 454 of the comb tooth 455. Each side edge 688 (FIG. 6) of the comb tooth 455 in the comb plate assembly 425 is substantially flush with the adjacent deck rings 440 that define the depicted deck channel 460. The space between adjacent deck rings 440 defines the deck channel width 367 (FIG. 3) of the deck channel 460. The deck channel width 367 may be uniform for each deck channel 460 along the length $L_2$ of drainage channel 450. In other exemplary embodiments, the deck channel width 367 may vary between deck channels 360 arrayed along the length $L_2$ of the drainage channel 450. In other exemplary embodiments, the deck channel width 367 may vary in a regular pattern. The comb teeth 455 of the comb plate assembly 425 are desirably substantially flush with the bottom 499 of the perforated plate 470, the top 422 of the drainage channels 450, and the sides 344$_a$, 344$_b$ of the deck rings 440 that define deck channel 460. In this manner, the comb teeth 455 of the comb plate assembly 425 are configured to direct filtrate 445 from the pulp slurry 485 and pulp mat 490 directly from the perforated plate 470 through the deck channel 460 and into the drainage channel 450 without allowing filtrate 445 to fall downwardly along the circumference C of deck channel 460 and into the pulp slurry 485 below the center line H as the drainage channels 450$_a$ rotate upwardly toward the center line H. A comb tooth 455 configured in this manner thereby mitigates the effects of upward rewetting.

Figure 6:
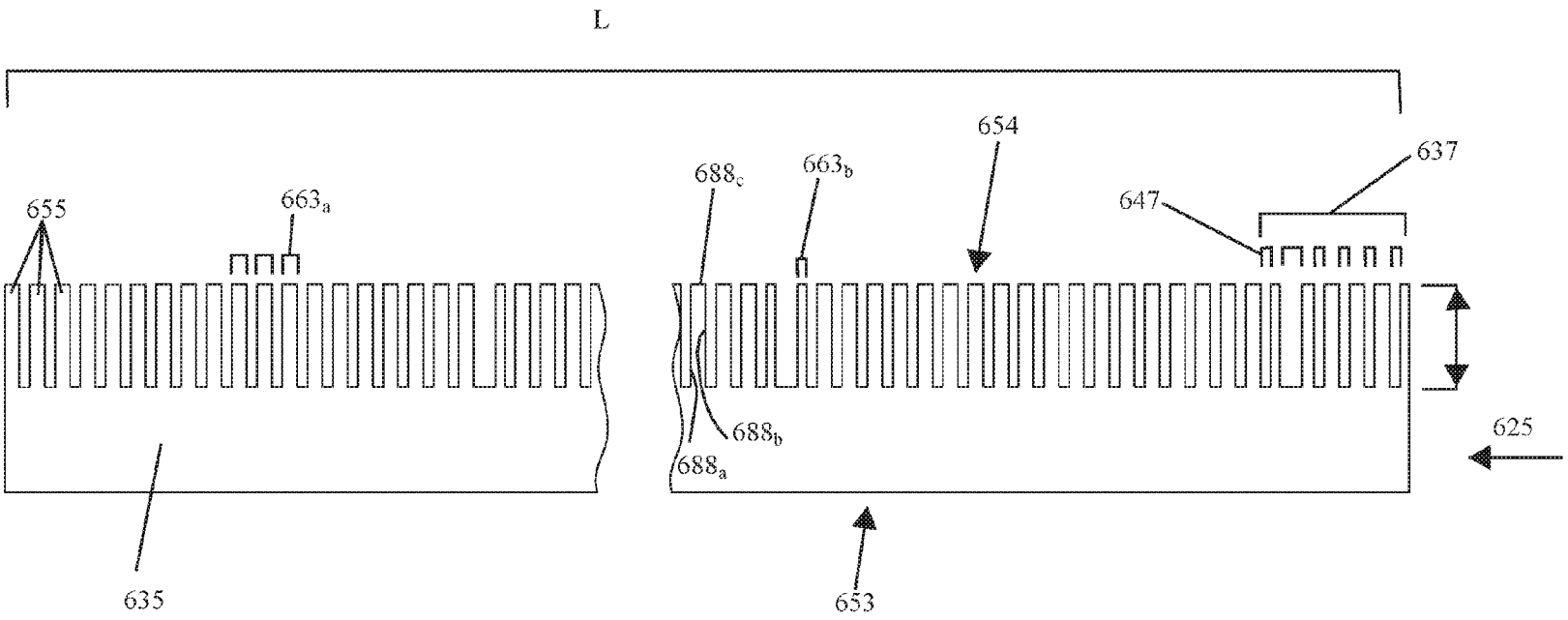
FIG. 6 is a top-down view of an exemplary comb plate depicting the support strip and comb teeth.
Figure 9:
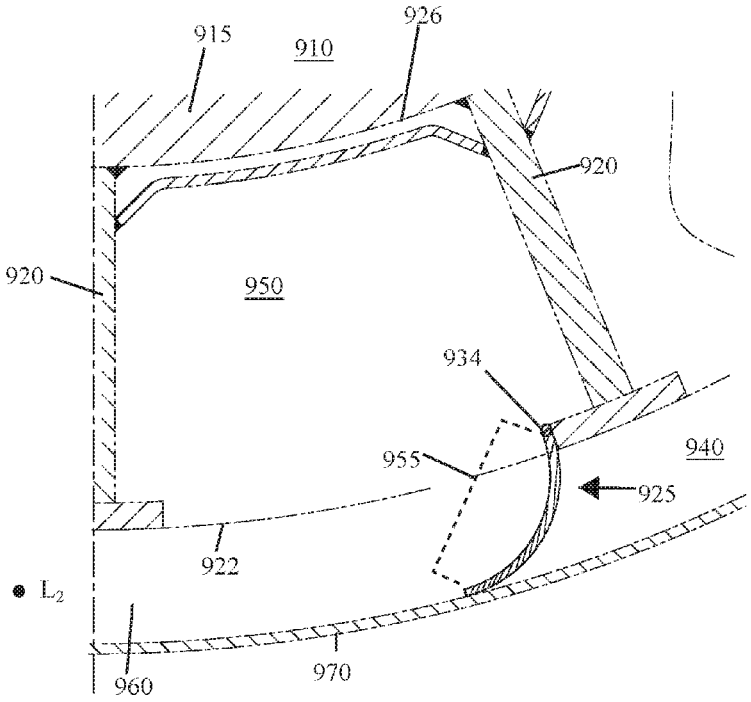
FIG. 9 is a cross-sectional view depicting another exemplary comb plate traversing the deck channel.

The comb plate assembly 425 may further comprise a support strip 435 disposed within the drainage channel 450, which extends along the length $L_2$ of the drainage channel 450 such that the support strip 435 supports multiple comb teeth 455 extending from the support strip 435 along the length L of the roll 400 (see FIG. 6). The support strip 435 may be the second end 453 of the comb plate assembly 425. In other exemplary embodiments, the support strip 435 may be a support bar 934 (FIG. 9). In embodiments where a support strip 435 is absent, the second end 453 of the comb plate assembly 425 may be the second end 479 of the comb tooth 455; that is, the end 479 of the comb tooth 455 opposite the first end 454 of the comb tooth 455. In the exemplary embodiment of FIG. 4, the support strip 435 engages a first channel side 468 of a support rib 420. The first channel side 468 of the support rib 420$_a$ is disposed opposite a second channel side 469 of a second support rib 420$_b$. The first channel side 468 and the second channel side 469 define the sides of drainage channel 450. Cladding plate 428 may further define the bottom 426 of the drainage channel 450.

In other exemplary embodiments, the support strip 435 may engage the cladding plate 428. In embodiments lacking a cladding plate 428, the support strip 435 may engage the division ring 415 or core 410 directly. In still other exemplary embodiments, the support strip 435 may engage a deck support structure 483 on the top 472 support rib 420 (see FIG. 10). In other exemplary embodiments, the support strip may engage the top 472 of the support rib 420. The first channel side 468, second channel side 469, cladding plate 428, division ring 415, bottom 426 of the drainage channel 450, top 472 of the support rib 420, bottom 417 of the deck support structure 483, first channel side 468$_a$ of the deck support structure 483, second channel side 469$_b$ of the deck support structure 483, or top 416 of a deck support structure 483, or other structural element defining the drainage channel 450 may be generically referred to as a "side" of the drainage channel 450. It will be understood that the support strip 435 may engage a side of the drainage channel 450 in exemplary embodiments. In embodiments lacking a support strip 435, the second end 543 of the comb plate assembly 425 may engage a side of the drainage channel 450.

The first end 454 and second end 479 of the comb tooth define a slope 473. In a counter-clockwise roll 401, the slope 473 is a positive slope 473' as the comb tooth 455 upwardly approaches the centerline H relative to the a coordinate plane formed by the horizontal centerline H and a straight line extending from the apex A (FIG. 5A) to the nadir N (FIG. 5D) of the counter-clockwise roll 401. Likewise, in a clockwise roll 402, the slope 473 is a negative slope 473" when the comb tooth 455 upwardly approaches the centerline H relative to a coordinate plane formed by the horizontal centerline H and a straight line extending from the apex A to the nadir N of the clockwise roll 402. The slope 473 may be defined by a function configured to be graphed on a coordinate plate. For example, the slope 473 may be defined by a mathematical function selected from a group consisting of a logarithmic function, an exponential function, segment of a parabolic function, segment of an absolute value function, segment of a sinusoidal function, segment of a tangential function, segment of a cosinusoidal function, segment of a secant function, segment of a cosecant function, segment of a cotangential function, or other function as graphed on a coordinate plane. A comb tooth 455 having a slope 473 as described herein further contributes to mitigation of the effects of upward rewetting.

The support strip 435 may extend along the entire length $L_2$ of the drainage channel 450. In other embodiments, the support strip 435 may extend partially along the length $L_2$ of the drainage channel 450, such that two or more comb plate assemblies 425 may be inserted in a drainage channel 450 along the length $L_2$ of the drainage channel 450. Each comb tooth 455 extends into a deck channel 460 and is substantially flush with the bottom 499 of the perforated plate 470 and each side $\mathbf{344}_a$, $\mathbf{344}_b$ of each deck ring 440 defining the deck channel width 367 of the deck channel 460. In this manner, filtrate 445 may be directed through the perforated plate 470 along a comb tooth 455 and into the drainage channels 450 along the length $L_2$ of the drainage channel 450. Although each comb tooth 455 desirably extends into the deck channel 460, in some exemplary embodiments, at least one comb tooth 455 extends into a deck channel 460. In further exemplary embodiments, the support strip 435 may be absent and comb teeth 455 extending into the deck channel 460 may engage a support rib 420 or other structure defining the drainage channel 450 individually.

In other exemplary embodiments, an anti-rewet plate 427 may be included in one or more drainage channels 450. The anti-rewet plate 427 may be contiguous with the support strip 435 of the comb plate assembly 425. In other exemplary embodiments, the anti-rewet plate 427 may be a separate insert separated from the comb plate assembly 425. The anti-rewet plate 427 may engage the second channel side 469 of a second support rib $\mathbf{420}_b$. In still other exemplary embodiments, the anti-rewet plate 427 may engage a deck support structure 483 on the support rib 420 (see FIG. 10). In other exemplary embodiments, the anti-rewet plate may engage a side of the drainage channel 450. The anti-rewet plate 427 may extend along the length $L_2$ of the drainage channels 450. In other embodiments, the anti-rewet plate 427 may extend partially along the length $L_2$ of the drainage channel 450 such that two or more anti-rewet plates 427 may be inserted into the drainage channels 450 along the length $L_2$ of the drainage channel 450.

FIG. 5 depicts orientations of a drainage channel 550 with an exemplary comb plate assembly 525 and anti-rewet plate 527 relative to the center line H. In FIG. 5C, the drainage channel 550 approaches the center line H upwardly as indicated by arrow R. In twin presses that use the exemplary comb plate assembly 525 and anti-rewet plate 527, a twin nip 480 (FIG. 4) would exist at center line H. The twin nip 480 presses filtrate $\mathbf{545}_f$ through the perforated plate 570 and the comb plate assembly 525 directs the filtrate $\mathbf{545}_f$ through the deck channel 560 and into the drainage channel 550 without allowing the filtrate $\mathbf{545}_f$ to fall down the circumference C of the deck channel 560 and into the pulp slurry 585. The drainage channel 550 collects the filtrate 545, and although the filtrate $\mathbf{545}_e$ begins to exit the drainage channel 550 through the ends 152 of the drainage channel 550, the level 521 of filtrate generally rises when the drainage channel 550 approaches centerline H in an upward direction. Filtrate $\mathbf{545}_h$ previously collected by the anti-rewet plate 527 falls down from the lip 529 of the anti-rewet plate 527 to mix with filtrate $\mathbf{545}_f$ newly entering the drainage channel 550.

Figure 5A:
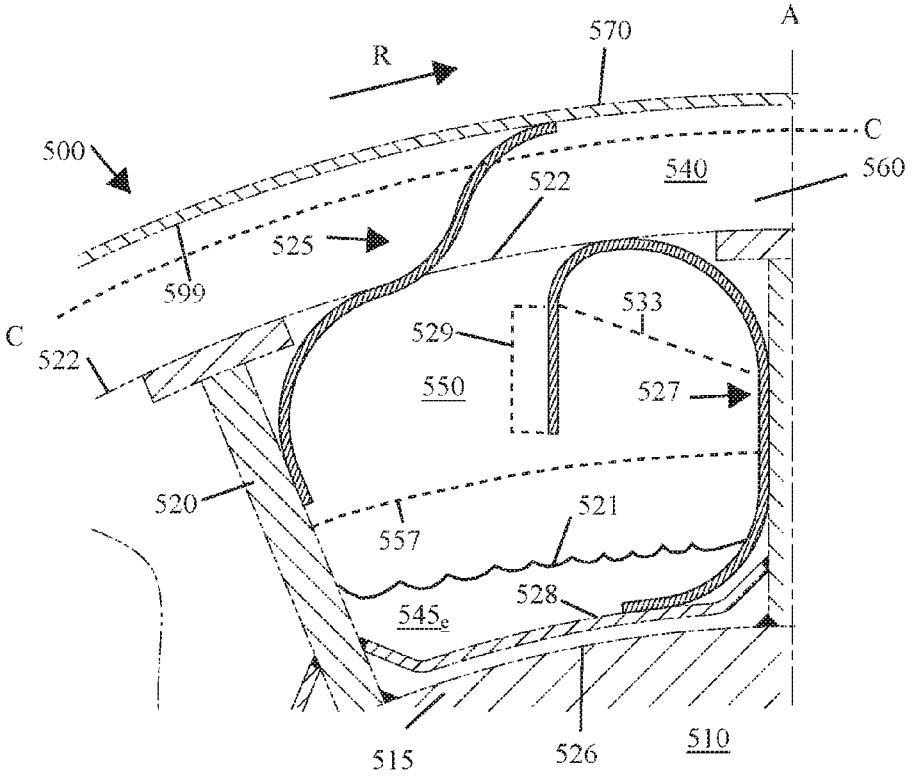
FIG. 5A is a cross-section view of an exemplary comb plate and anti-rewet plate approaching the apex of the roll; the apex is oriented 90 degrees relative to the center line.

As the drainage channel 550 rotates past the center line H and begins to approach the apex A of the roll 500 as depicted in FIG. 5A, a greater volume of filtrate $\mathbf{545}_e$ generally flows out of the drainage channels 550 through the ends 152 of the drainage channels 550 than the volume of filtrate 545 flowing out of the ends 152 of the drainage channels 550 when the drainage channel 550 was closer to the center line H. As a result of the rate of rotation and the width 557 of the drainage channels 550, not all filtrate $\mathbf{545}_e$ exits the drainage channel 550 when the drainage channel 550 is above the center line H.

Figure 5B:
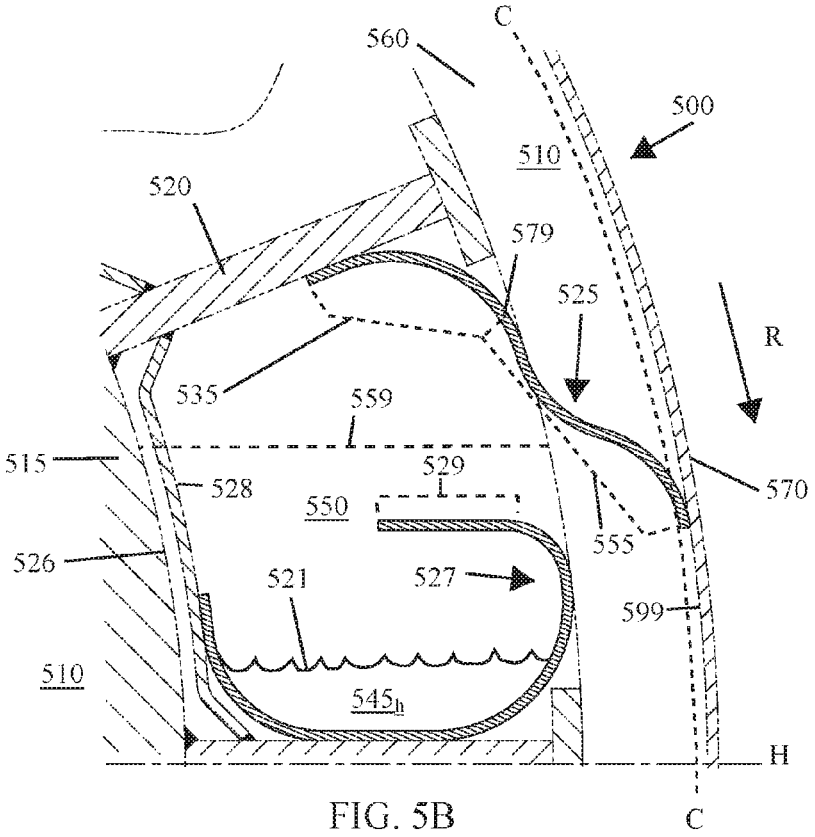
FIG. 5B is a cross-section view of an exemplary comb plate and anti-rewet plate, in which the exemplary comb-plate and anti-rewet plate have passed the apex and are approaching the center line in a downward direction.
Figure 5C:
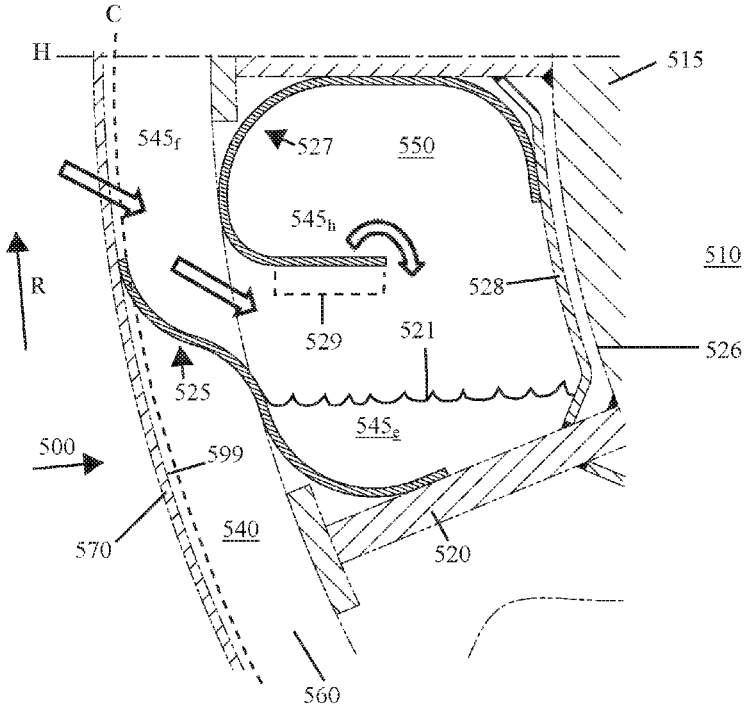
FIG. 5C is a cross-section view of an exemplary comb plate and anti-rewet plate approaching the nadir of the roll; the nadir is oriented 180 degrees from the apex.
Figure 5D:
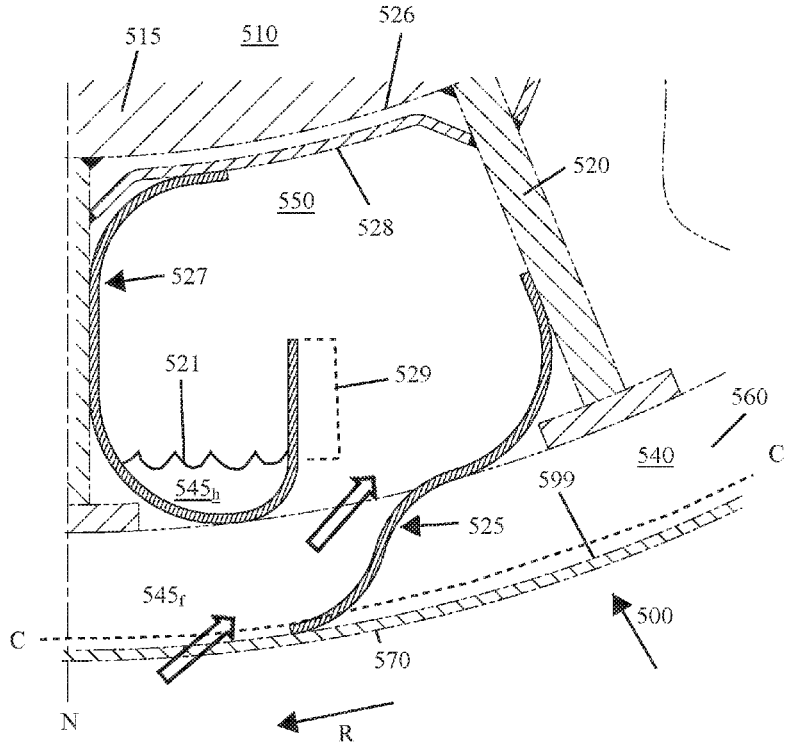
FIG. 5D is a cross-section view of an exemplary comb plate and anti-rewet plate approaching the center line in an upward direction.

FIG. 5B depicts the anti-rewet plate 527 collecting the filtrate $\mathbf{545}_h$ that did not drain from the drainage channels 550. The anti-rewet plate 527 begins to collect the filtrate $\mathbf{545}_h$ as the drainage channel 550 passes the apex A and begins to rotate downwardly toward the center line H. The filtrate $\mathbf{545}_h$ collected in the anti-rewet plate 527 above the center line H may continue to flow out of the ends 152 of the drainage channels 550, thereby reducing the volume of filtrate $\mathbf{545}_h$ mixing with new filtrate $\mathbf{545}_f$. As the drainage channel 550 rotates downwardly past the center line H and toward the nadir N of the roll 500 (at the 6:00 position), a cradle 533 or concave area the anti-rewet plate 527 collects the filtrate $\mathbf{545}_h$. New filtrate $\mathbf{545}_f$ begins to flow into the drainage channel 550 along the comb plate assembly 525. Nips (see U.S. Pat. No. 8,828,189) may facilitate new filtrate $\mathbf{545}_f$ transfer into the drainage channel 550 at the orientation depicted in FIG. 5D.

In other exemplary embodiments, the comb plate assembly 525 may further include the anti-rewet collection plate 527 extending from an end of the support strip 535 opposite the multiple comb teeth 555. The anti-rewet collection plate 527 may be disposed within a drainage channel 550, wherein the drainage channel 550 communicates with a portion of a deck channel 560 having the at least one comb tooth 555 of comb plate assembly 525. The anti-rewet collection plate 527 may be attached to the support strip 535 of the comb tooth 555 such that the anti-rewet plate 527 extends from an end of the support strip 535 opposite at least one comb tooth 555.

FIG. 6 depicts an exemplary comb plate assembly 625 in accordance with the present disclosure. The comb plate assembly 625 comprises a support strip 635 and multiple comb teeth 655. The width $\mathbf{663}_a$ of the comb teeth 655 may be uniform, or the widths $\mathbf{663}_b$ of the comb teeth 655 may vary to accommodate the deck channel widths 367 of the deck channels 560. The widths 663 of the comb teeth 655 desirably match the deck channel widths 367. However, in certain exemplary embodiments, less than all of a comb tooth width 663 may match a deck channel width 367. The comb teeth 655 extend into the deck channels 560 and thereby direct filtrate 545 into the drainage channels 550 without having the filtrate 545 falling downwardly through the circumference C of the deck channels 560 and into the pulp slurry 485. The comb teeth 655 have side edges $\mathbf{688}_a$, $\mathbf{688}_b$, and $\mathbf{688}_c$. Side edges $\mathbf{688}_a$ and $\mathbf{688}_b$ may be flush with the sides $\mathbf{344}_a$, $\mathbf{344}_b$ of the deck rings 340 that define deck channel 360. In certain exemplary embodiments, the side edges $\mathbf{688}_a$ and $\mathbf{688}_b$ may engage the sides $\mathbf{344}_a$, $\mathbf{344}_b$ of the deck rings 340. In other embodiments, the side edges $\mathbf{688}_a$ and $\mathbf{688}_b$ may be disposed adjacent to the sides $\mathbf{344}_a$, $\mathbf{344}_b$ of the deck rings 340. Side edge $\mathbf{688}_c$ may be at the first end 654 of a comb tooth 655. The support strip 635 may be at the second end 653 of the comb plate assembly 625. In an exemplary embodiment, the comb plate assembly 625 may further comprises a support strip 635 and multiple comb teeth 655, wherein the support strip 635 is disposed within the drainage channel 550 and each comb tooth 655 extends from the support strip 635, through a portion of deck channel 560 in communication with a drainage channel 550 and to the perforated plate 570 at intervals 637. The intervals 637 may correspond to a width 647 (and see 347 FIG. 3) of the deck rings such that side edges $688_a$, $688_b$ of each comb tooth 655 engage sides $344_a$, $344_b$ of the deck rings 340. The support strip 635 may extend the length $L_2$ of the drainage channel 550. In certain embodiments, the comb plate assembly 625 may be is disposed in substantially all drainage channels 550. In other exemplary embodiments, the comb plate assembly 625 may be disposed in at least one drainage channel 550. In still other exemplary embodiments, the comb plate assembly 625 may be disposed in more than one drainage channel 550, but less than all drainage channels 550.

Figure 7:
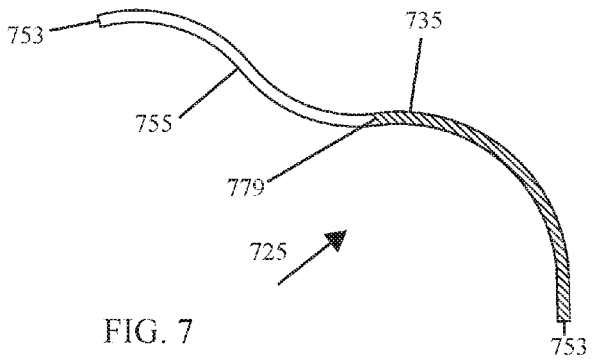
FIG. 7 is a cross-sectional view of an exemplary comb plate depicting the support strip and a comb tooth.

FIG. 7 is an exemplary embodiment of the comb plate assembly 725 comprising a comb tooth 755 and a support strip 735. The second end 753 of the comb plate assembly 725 is on the support strip 735. The first end 754 of the comb tooth 755 may be disposed on the back 499 of a perforated plate 470. The second end 779 of the comb tooth 755 is opposite the first end 745 of the comb tooth 755. The comb plate assembly 725 may be made of stainless steel, duplex high grade steel, or other suitable material configured to withstand the caustic environment of the roll 500. In bleaching applications, the pH within the drainage channels 550 may range from about 2 to about 7. In non-bleaching thickening applications, the pH within the drainage channels 550 may range from 6 to about 12. The force the comb plate assembly 725 undergoes at a nip 480 may range from 800 pound per lineal inch ("PLI") to 1,500 PLI. The comb plate assembly 725 is desirably made of a material sufficiently durable and flexible to withstand this force repeatedly.

Figure 8:
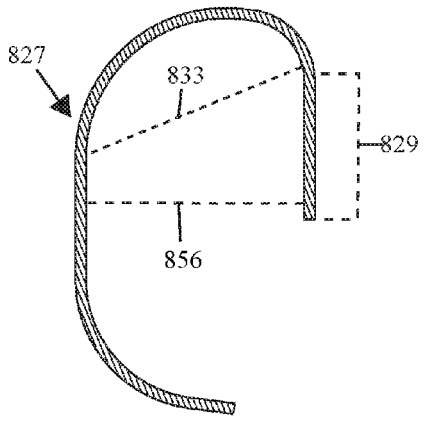
FIG. 8 is a cross-sectional view of an exemplary anti-rewet plate.

FIG. 8 is an exemplary embodiment of the anti-rewet plate 827 comprising a cradle 833 and a lip 829 extending about halfway into the drainage channel 550. The cradle 833, of the anti-rewet plate 827, which may be a concave area, or other similar shape configured to prevent rewetting between the apex A (12 o'clock position) and the upward approach to the centerline H (the 9 o'clock position if the roll 500 rotates clockwise and the 3 o'clock position if the roll 500 rotates counter clockwise). The cradle 833 may extend to the top 522 of at least one drainage channel 550 and be oriented toward the bottom 526 of the drainage channel 550. The width 856 of the cradle 833, as measured from the side of the anti-rewet plate 827 disposed on the support rib 520 to the point at which the anti-rewet plate 827 begins to turn inwardly toward the drainage channel 550, may extend into the drainage channel 550 in a range from 0% the width 557 of the drainage channel 550 to about 60% of the width 557 of the drainage channel 550. The width 856 of the cradle 833 extending beyond 60% the width 557 of the drainage channel 550 may substantially interfere with having an opening at the top 522 of the drainage channel 550 sufficiently wide to admit the filtrate 545 from the deck channel 560 at practical production rates.

The anti-rewet plate 827 may further comprise a lip 829 that extends between 20% to about 70% the height 559 of the drainage channel 550. The lip 829 may be vertically oriented within the drainage channel 550 relative to the top 522 and bottom 526 of the drainage channel 550. In other exemplary embodiments, the lip 829 may be oriented at an acute angle relative to the cradle 833 of the anti-rewet plate 827. In yet other embodiments, the lip 829 may be oriented at an obtuse angle relative to the cradle 833 of the anti-rewet plate 827. In still other exemplary embodiments, the anti-rewet plate 827 may be concavely curved relative to the concave portion of the anti-rewet plate 827. In yet other exemplary embodiments, the anti-rewet plate 827 may be convexly curved relative to the concave portion of the anti-rewet plate 827. Nothing in this disclosure shall restrict the combinations of previously enclosed exemplary embodiments contained herein.

The anti-rewet plate 827 may be made from stainless steel, duplex high grade steel, or any other material suitable to withstand the caustic environment within the drainage channels 550. The anti-rewet plate 827 may be secured to a support rib 520 by welding, clamps, rivets, bolts, or other fasteners configured to withstand the caustic environment of the drainage channels 550.

FIG. 9 is an exemplary embodiment of the comb plate assembly 925 in which the comb teeth 955 traverse the deck channels 960 and the support strip 735 is a support bar 934 connected to a support rib 920 in the drainage channel 950. The support bar 934 is substantially less wide than the support strip 635 depicted in FIG. 6. The support bar 934 may extend the entire length $L_2$ of the drainage channel 950 or the support bar 934 may extend partially through the length $L_2$ of the drainage channel 950 such that two or more comb plate assemblies 925 may be inserted into a drainage channel 950 along the length $L_2$ of the drainage channel 950.

Figure 10:
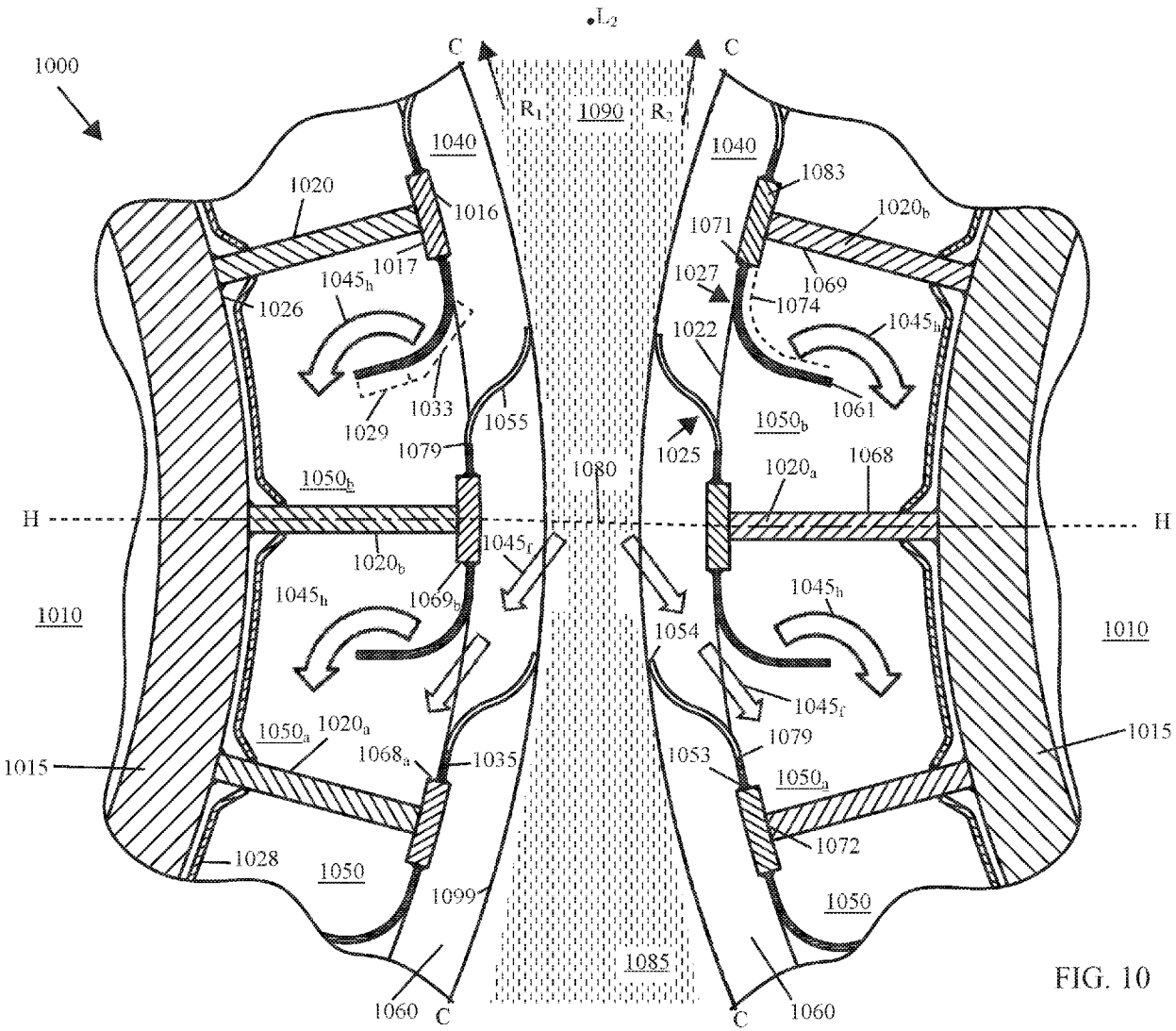
FIG. 10 is a cross-sectional view of another exemplary embodiment of the present disclosure depicting a twin roll press with an anti-rewet insert comprising a comb plate extending to the back of the perforated plate toward a rib and an anti-rewet plate having a disposed within a drainage channel and a second end engaging a rib.

FIG. 10 depicts a further exemplary assembly comprising a comb plate and anti-rewet plate. Support strip 1035 engages comb plate assembly 1025 to the first channel side $1068_a$ of the deck support structure 1083 comprising first support rib $1020_a$. The support strip 1035 may extend the length $L_2$ of the drainage channel 1050. In other exemplary embodiments, the support strip 1035 may extend less than the length $L_2$ of the drainage channel 1050 and more than one comb plate assembly 1025 may be used in the same drainage channel 1050.

In the exemplary embodiment of FIG. 10, the anti-rewet plate 1027 has a second end 1071 engaging the second channel side $1069_b$ of the second support rib $1020_b$. The first end 1061 of the anti-rewet plate 1027 extends into the drainage channel 1050. The lip 1029 extends from the first end 1061 of the anti-rewet plate 1027 to the cradle 1033. The first end 1061 and second end 1071 define a concave slope 1074 configured to hold a volume of filtrate 1045 as the drainage channel 1050 rotates downwardly between the center line H and the nadir N of the roll 1000. The cradle 1033 is disposed between the lip 1029 and the second end 1071 of the anti-rewet plate 1027.

In other exemplary embodiments, the comb plate assembly 1025 may engage the top 1016 of the deck support structure 1083. In still further exemplary embodiments, the comb plate assembly 1025 may engage a bottom 1017 of the deck support structure 1083. In still other exemplary embodiments, the support strip 1035 may be a support bar 934. In other exemplary embodiments, the comb plate assembly 1025 may not include a support strip 1035.

Likewise, in certain exemplary embodiments, anti-rewet plate 1027 may engage the top 1016 of the deck support structure 1083. In still further exemplary embodiments, the anti-rewet plate 1027 may engage a bottom 1017 of the deck support structure 1083.

In an exemplary embodiment, a roll press deck channel anti-rewet assembly comprises: a roll having a support ribs arrayed across a length of the roll, wherein adjacent support ribs define drainage channels, and wherein ends of the drainage channels are disposed at ends of the roll; a deck disposed on tops of the support ribs, wherein the deck comprises deck rings defining a deck channel communicating with a top of the drainage channels and a perforated plate disposed on a top of the deck rings, wherein perforated plate has areas defining perforations in the communication with the deck channel; and a comb plate disposed under a perforated plate, the comb plate comprising a comb tooth extending through the deck channel toward a drainage channel, the comb tooth having a first end disposed on a back of the perforated plate and a second end opposite the first end, wherein the first end and the second end of the comb tooth define a slope configured to direct filtrate from the perforated plate through the deck channel into the drainage channel.

An exemplary roll press deck channel anti-rewet assembly may further comprise an anti-rewet plate disposed under the perforated plate, wherein the anti-rewet plate engages a side of the drainage channel, wherein the anti-rewet plate has a first end extending into the drainage channel and a second end, and wherein the first end and the second end define a concave slope configured to hold a volume of filtrate in the drainage channel as the drainage channel rotates downwardly between the center line and a nadir of the roll.

An exemplary roll press deck channel anti-rewet assembly may have a deck that further comprises multiple deck rings disposed on the tops of support ribs, wherein adjacent deck rings define deck channels between adjacent deck rings. The comb plate may further comprise multiple comb teeth extending through the deck channels communicating with the tops of the drainage channels. The comb plate may further comprise a support strip and multiple comb teeth, wherein the support strip engages a side of a drainage channel and comb teeth extend from the perforated plate, through a deck channel in communication with a drainage channel and into the support strip at intervals.

An exemplary deck channel anti-rewet assembly comprising a comb plate may have support strip extending the length of the drainage channel. The comb plate may be disposed in all drainage channels on a press roll in an exemplary embodiment. The intervals may correspond to a width of deck rings disposed on the tops of support ribs, such that side edges of comb teeth engage sides of the deck rings in an exemplary embodiment.

In example embodiments comprising an anti-rewet collection plate disposed within a drainage channel with the comb plate, the anti-rewet plate may not extend into the deck channels. The comb plate may further comprise an anti-rewet collection plate extending from an end of the support strip opposite the multiple comb teeth.

A method for installing a comb plate and anti-rewet plate has been conceived comprising: stopping rotational movement of the roll in a roll press, wherein the roll has support ribs arrayed across a length of the roll, wherein adjacent support ribs define drainage channels, wherein ends of the drainage channels are disposed at ends of the roll, wherein the roll further comprises a deck disposed on tops of the support ribs, the deck defines a deck channel communicating with a top of the drainage channels, and wherein a perforated plate is disposed on a top of the deck, and wherein the perforated plate defines perforations in communicates with the deck channel; removing the perforated plate defining an outer surface of the roll; exposing ends of drainage channels; inserting a comb plate along a length of a drainage channel, the comb plate comprising a comb tooth, wherein the comb tooth does not extend into deck channel; tilting the comb plate such that the comb teeth extend into at least one deck channel such that comb plate disposed under a perforated plate extending through the deck channel toward a drainage channel, the comb tooth having a first end disposed on a back of the perforated plate and a second end opposite the first end, wherein the first end and the second end of the comb tooth define a slope configured to direct filtrate from the perforated plate through the deck channel into the drainage channel; securing the comb plate to a support rib of a drainage channel; and reinstalling the perforated plate to define an outer surface of the roll.

The method may further comprise adding an anti-rewet plate along the length of the drainage channel after the comb plate has been inserted along the length of the drainage channel, and securing the anti-rewet plate to a support rib opposite a support rib containing a comb plate.

An exemplary roll for use in a roll press has been conceived comprising: a core having an outer surface and a length; longitudinal support ribs disposed substantially parallel along the length of the outer surface, wherein adjacent longitudinal support ribs define drainage channels; a deck comprising deck rings, wherein the deck rings are disposed proximate to an outer end of the longitudinal support ribs such that the deck rings transverse the drainage channels, wherein adjacent deck rings define deck channels, and wherein portions of the deck channels communicate with the drainage channels; a perforated plate surrounding the deck; and a comb plate comprising at least one comb tooth engaging the perforated plate and extending through a deck channel to a drainage channel such that the at least one comb tooth is configured to direct a slurry suspension from the perforated plate into the drainage channel.

The comb plate may comprise multiple comb teeth extending through substantially all portions of the deck channels communicating with the drainage channels.

A method has been conceived comprising feeding a pulp slurry into a roll press, pressing filtrate out of the pulp slurry and through a perforated plate to form a pulp mat as a roll, in the roll press rotates, directing the filtrate flowing from the perforated plate through a deck channel and into a drainage channel with a comb plate having a support strip and at least one comb tooth extending from the top of the drainage channel through the deck channel and contacting the perforated plate, and rotating a drainage channel in the roll upwardly past the center line toward an apex.

The method may further comprise rotating the drainage channel in the roll past the apex A such that the drainage channel rotates downwardly toward the center line, reducing rewetting of pulp as the drainage channel rotates downwardly toward the center line by using an anti-rewet plate with a cradle oriented toward a bottom of the drainage channel, and reducing rewetting of pulp as the drainage channel rotates downwardly past the center line toward a nadir N of the roll by using an anti-rewet plate with a cradle oriented toward a bottom of the drainage channel.

In other exemplary embodiments, at least one comb tooth of the comb plate may be concave relative to the adjacent deck rings so as to define a trough that directs filtrate from the perforated plate to a drainage channel. The comb teeth may have a V-shape, in which the ends of the "V" engage adjacent deck rings and the lowest point of the "V" is located furthest from the perforated plate. In other exemplary embodiments, the "V" may be inverted. In other exemplary embodiments, the comb teeth may be parabolic, such that the ends of the parabola engage the adjacent deck rings defining a deck channel and the lowest point of the parabola is located furthest from the perforated plate. In still other exemplary embodiments, the comb teeth may be generally U-shaped, such that the ends and sides of the "U" engage the adjacent deck rings, which define a deck channel and the bottom of the "U" is located furthest from the perforated plate. In still other embodiments, an operator may use a combination of these features.

In certain exemplary embodiments, the comb teeth may have a uniform width and be disposed at uniform intervals along a support strip of the comb plate. In other exemplary embodiments, the width of the comb teeth may vary with the width of the deck channels. In still other exemplary embodiments, the comb plate may not have comb teeth in every deck channel. In these embodiments, a roll may have a first comb plate at every second deck channel and a second comb plate located in a drainage channel below the first comb plate relative to the direction of rotation may have comb teeth in every deck channel not occupied by the comb teeth of the first comb plate. In this manner, the first comb plate may collect filtrate from even-numbered deck channels and the second comb plate may collect filtrate from odd numbered check channels. More than two comb plates may be used. Gaps between comb teeth may be governed by a regular pattern. In other exemplary embodiments, the gaps between comb teeth may be governed by an irregular pattern.

Each comb tooth may be supported by a support strip. In other exemplary embodiments, each comb tooth may be supported by a support rod disposed within a drainage channel. In still other embodiments, the comb teeth may be individually fixed within the deck channels such that no support structure spans a length of a drainage channel.

The roll press may further comprise an anti-rewet plate disposed within the comb plate, wherein the anti-rewet plate does not extend into the deck channels. In other exemplary embodiments, the anti-rewet plate may be disposed in substantially all drainage channels. The anti-rewet plate may extend partially into the deck channel. In still other exemplary embodiments, the anti-rewet plate may be disposed within the drainage channel such that the cradle of the anti-rewet plate is not flush with the top of the drainage channel, but rather is disposed below the top of the drainage channel. A generally C-shaped anti-rewet plate having its cradle oriented toward the center of the drainage channel and disposed opposite a comb plate may reduce substantially the rewetting causes when a drainage channel approaches and passes the centerline in a downward direction.

Another exemplary method for installing a comb plate and anti-rewet plate has been conceived comprising stopping rotational movement of the roll in a roll press, removing a perforated plate defining an outer surface of the roll, exposing ends of the drainage channels, inserting a comb plate along a length of a drainage channel, wherein comb teeth do not extend into deck channels, tilting the comb plate such that the comb teeth extend into at least one deck channel securing the comb plate to a longitudinal support rib of a drainage channel, and reinstalling the perforated plate to define an outer surface of the roll.

The method for installing a comb plate and anti-rewet plate may further comprise adding an anti-rewet plate along the length of the drainage channel after the comb plate has been inserted along the length of the drainage channel, and securing the anti-rewet plate to a longitudinal support rib opposite a longitudinal support rib containing a comb plate.

While this invention has been particularly shown and described with references to example embodiments thereof, it will be understood by those skilled in the art that various changes in form and details may be made therein without departing from the scope of the invention encompassed by the appended claims.

What is claimed is:

1. A roll press deck channel anti-rewet assembly comprising:

a roll having support ribs arrayed across a length of the roll, wherein adjacent support ribs define drainage channels, and wherein ends of the drainage channels are disposed at ends of the roll;

a deck disposed on tops of the support ribs, wherein the deck comprises deck rings defining a deck channel communicating with a top of the drainage channels and a perforated plate disposed on a top of the deck rings, wherein the perforated plate has areas defining perforations in communication with the deck channel; and a comb plate disposed under the perforated plate, the comb plate comprising a comb tooth extending through the deck channel toward at least one of the drainage channels, the comb tooth having a first end disposed on a back of the perforated plate and a second end opposite the first end disposed in at least one of the drainage channels, wherein the first end and the second end of the comb tooth define a slope configured to direct filtrate from the perforated plate through the deck channel and into at least one of the drainage channels.

2. The assembly of claim 1, further comprising an anti-rewet plate disposed under the perforated plate, wherein the anti-rewet plate engages a side of at least one of the drainage channels, wherein the anti-rewet plate has a first end extending into the at least one of the drainage channels and a second end, and wherein the first end and the second end define a concave slope configured to hold a volume of filtrate in the drainage channel as the at least one of the drainage channels rotates downwardly between a center line and a nadir of the roll.

3. The assembly of claim 1, wherein the deck further comprises multiple deck rings disposed on the tops of support ribs, wherein adjacent deck rings define deck channels between adjacent deck rings.

4. The assembly of claim 3, wherein the comb plate further comprises multiple comb teeth extending through the deck channels communicating with the tops of the drainage channels.

5. The roll of claim 4, wherein the comb plate further comprises a support strip and multiple comb teeth, wherein the support strip engages a side of at least one of the drainage channels and the comb teeth extend from the perforated plate, through at least one of the deck channels which is in communication with the at least one of the drainage channels, and into the support strip at intervals.

6. The assembly of claim 5, wherein the support strip extends the length of the at least one of the drainage channels.

7. The assembly of claim 5, wherein a comb plate is disposed in all drainage channels on a press roll.

8. The assembly of claim 5, wherein the intervals correspond to a width of the deck rings disposed on the tops of support ribs, such that side edges of the comb teeth engage sides of the deck rings.

9. The assembly of claim 8 further comprising an anti-rewet collection plate disposed within a drainage channel with the comb plate, wherein the anti-rewet collection plate does not extend into the deck channels.

10. The assembly of claim 8, wherein the comb plate further comprises the anti-rewet collection plate extending from an end of the support strip opposite the multiple comb teeth.

11. The assembly of claim 5, wherein the side edges of at least one comb tooth engage sides of the deck rings.

12. The assembly of claim 1, wherein the support ribs further comprise a deck support structure engaged to the support ribs.

13. The assembly of claim 1, wherein the slope has a shape selected from a function selected from consisting of a logarithmic function, an exponential function, segment of a parabolic function, segment of an absolute value function, segment of a sinusoidal function, segment of a tangential function, segment of a cosinusoidal function, segment of a secant function, segment of a cosecant function, and segment of a cotangential function as graphed on a coordinate plane.

14. A method for installing a comb plate and anti-rewet plate comprising:

stopping rotational movement of a roll in a roll press, wherein the roll has support ribs arrayed across a length of the roll, wherein adjacent support ribs define drainage channels, wherein ends of the drainage channels are disposed at ends of the roll, wherein the roll further comprises a deck disposed on tops of the support ribs, the deck defines a deck channel communicating with a top of the drainage channels, and wherein a perforated plate is disposed on a top of the deck and defines an outer surface of the roll, and wherein the perforated plate defines perforations in communication with the deck channel;

removing the perforated plate exposing ends of the drainage channels;

inserting a comb plate along a length of at least one of the drainage channels, the comb plate comprising a comb tooth, wherein the comb tooth does not extend into the deck channel;

tilting the comb plate such that the comb teeth extend into the deck channel and such that comb plate will be disposed under the perforated plate after the perforated plate is reinstalled, and such that the comb plate extends through the deck channel toward the at least one of the drainage channels, the comb tooth having a first end that will be disposed on a back of the perforated plate after the perforated plate is reinstalled and a second end opposite the first end disposed in the at least one of the drainage channels, wherein the first end and the second end of the comb tooth define a slope configured to direct filtrate from the perforated plate through the deck channel into the at least one of the drainage channels;

securing the comb plate to a support rib of the at least one of the drainage channels; and reinstalling the perforated plate to define an outer surface of the roll.

15. The method of claim 14 further comprising adding an anti-rewet plate along the length of the drainage channel after the comb plate has been inserted along the length of the drainage channel, and securing the anti-rewet plate to a support rib opposite a support rib containing a comb plate.

* * * * *